US011117040B2

(12) United States Patent
LoMedico

(10) Patent No.: US 11,117,040 B2
(45) **Date of Patent: *Sep. 14, 2021**

(54) BATTING PAD FOR ADJUSTING LOCATION OF BAT IN BATTER'S HAND

(71) Applicant: Pro-Hitter Corporation, New City, NY (US)

(72) Inventor: Philip R LoMedico, Pembroke Pines, FL (US)

(73) Assignee: Pro-Hitter Corporation, New City, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/279,792

(22) Filed: Feb. 19, 2019

(65) Prior Publication Data

US 2019/0176013 A1 Jun. 13, 2019

Related U.S. Application Data

(63) Continuation of application No. 15/461,199, filed on Mar. 16, 2017, now Pat. No. 10,238,951, which is a continuation of application No. 14/292,526, filed on May 30, 2014, now Pat. No. 9,603,394, which is a continuation of application No. 13/462,807, filed on May 2, 2012, now Pat. No. 8,763,162.

(51) Int. Cl.
*A63B 71/14* (2006.01)
*A41D 13/08* (2006.01)

(52) U.S. Cl.
CPC ..... *A63B 71/14* (2013.01); *A41D 13/082* (2013.01)

(58) Field of Classification Search
CPC ..... A41D 13/082; A63B 71/14
See application file for complete search history.

(56) References Cited

U.S. PATENT DOCUMENTS

| | | | |
|---|---|---|---|
| 1,200,580 | A | 10/1916 | Brenner |
| 1,483,595 | A | 2/1924 | Read |
| 2,637,031 | A | 5/1953 | Friedman |
| 2,651,776 | A | 9/1953 | Beatty |
| 2,651,778 | A | 9/1953 | Wohlman |
| 2,670,736 | A | 3/1954 | Dunkelberger |
| 2,797,687 | A | 7/1957 | Crawford |
| 2,999,243 | A | 9/1961 | Gross et al. |
| 4,461,043 | A | 7/1984 | Lomedico |

(Continued)

FOREIGN PATENT DOCUMENTS

| | | | |
|---|---|---|---|
| EP | 0064432 | A1 | 11/1982 |
| GB | 139400 | A | 3/1920 |

*Primary Examiner* — Richale L Quinn
(74) *Attorney, Agent, or Firm* — Faegre Drinker Biddle & Reath LLP

(57) ABSTRACT

A batting pad comprising a body made from a cushioning material and having a ring portion adapted to fit over a batter's thumb and an appendage to cushion the palm area between a batter's thumb and index finger. The appendage has a thickness T at its thickest point located between the first end and the distant end, and the thickness T of the appendage is selected to optimize an angle of a bat in the batter's hand relative to a line parallel to the batter's forearm, the angle being determined by the thickness T of the appendage displacing the bat toward the tip of the batter's index finger and causing the bat to contact the palm of the batter's hand near the batter's little finger.

13 Claims, 10 Drawing Sheets

(56) References Cited

U.S. PATENT DOCUMENTS

| | | | | |
|---|---|---|---|---|
| 4,615,046 | A | 10/1986 | Martin | |
| D291,466 | S | 8/1987 | Taube | |
| 4,845,777 | A | 7/1989 | Mersinas | |
| 5,069,454 | A | 12/1991 | Frost | |
| 5,069,455 | A | 12/1991 | Thomas | |
| 5,180,165 | A | 1/1993 | Frost | |
| 5,184,815 | A | 2/1993 | Maddox | |
| 5,471,682 | A | 12/1995 | Robins et al. | |
| 5,604,934 | A | 2/1997 | Willett | |
| 5,636,381 | A | 6/1997 | Brogden | |
| 5,806,091 | A | 9/1998 | McHugh | |
| 5,819,312 | A | 10/1998 | Snyder et al. | |
| 5,983,397 | A | 11/1999 | Seminara | |
| 6,088,834 | A | 7/2000 | Seminara | |
| 6,260,198 | B1 | 7/2001 | LoMedico | |
| 6,389,596 | B2 | 5/2002 | LoMedico | |
| 6,532,594 | B1 | 3/2003 | Barnett | |
| 6,799,329 | B2 | 10/2004 | LoMedico | |
| 6,996,849 | B2 | 2/2006 | LoMedico | |
| 7,484,248 | B2 | 2/2009 | LoMedico | |
| 8,763,162 | B2 | 7/2014 | Lomedico | |
| 9,603,394 | B2 | 3/2017 | LoMedico | |
| 9,899,012 | B2 | 2/2018 | First | |
| 10,238,951 | B2 | 3/2019 | LoMedico | |
| 2009/0313737 | A1* | 12/2009 | Richard | A41D 13/082 2/20 |
| 2014/0283274 | A1 | 9/2014 | Lomedico | |
| 2017/0182396 | A1 | 6/2017 | LoMedico | |

* cited by examiner

BATTING PAD FOR ADJUSTING LOCATION OF BAT IN BATTER'S HAND

CROSS-REFERENCE TO RELATED APPLICATION

This application is a continuation of U.S. application Ser. No. 15/461,199, filed Mar. 16, 2017, which is a continuation of U.S. application Ser. No. 14/292,526, filed May 30, 2014, now U.S. Pat. No. 9,603,394, which is a continuation of U.S. application Ser. No. 13/462,807, filed May 2, 2012, now U.S. Pat. No. 8,763,162, all of which are herein incorporated by reference in their entireties.

BACKGROUND

This invention relates generally to baseball accessories for aiding a batter in properly gripping and controlling a baseball or softball bat and for protecting a batter's hand from bruising or injury, including bone bruise injuries. More particularly, this invention relates to a pad worn over the thumb and between the thumb and forefinger for aiding a batter in gripping a bat.

To properly grasp a baseball bat, the batter should place the bat handle diagonally across an open hand, then grasp the bat primarily with the fingers, and not with the palm of the hand. The index finger and the middle finger are particularly important in grasping a bat. Grasping the bat primarily with the fingers instead of the palm not only aids the batter in controlling the bat, but it helps the batter more securely grasp the bat. A grip using primarily the fingers thus increases leverage, bat control and placement, and bat speed, thus allowing a more powerful and accurate batting stroke. If a bat is grasped deep in the palm of the hand, and if the bat rests back in the area between the thumb and index finger, the batter is not likely to have proper control of the bat, the bat may wiggle or slide between the fingers and into the palm area between the thumb and index finger, and the batter's leverage, bat control and placement, and bat speed and power may be reduced.

A strong shock or sting is often sent through a bat to a batter's hand when the batter hits a ball off the thin portion of the bat or off the end of the bat. This shock can bruise the batter's hand, particularly the area of the palm (typically near or at the base of the thumb) and index finger (typically near or at the base of the index finger). Many batters develop a bruise near or at the joint of the thumb and the hand or near or at the joint of the index finger and the hand. These bruises can interfere with a batter's game, can be painful, and can linger for an extended or permanent period of time due to periodically recurring shocks to the same area of the hand. Many devices are known in the art to reduce the effect of the shock from hitting a baseball off the wrong spot on a bat. Some of these devices include batting gloves, which dull shocks from hitting a baseball, and pads to cushion the area between the thumb and index finger. One such pad is disclosed in U.S. Pat. No. 4,461,043, which is hereby incorporated by reference in its entirety. Another such pad is discussed in U.S. Pat. No. 7,484,248, which is hereby incorporated by reference in its entirety.

SUMMARY

The present invention, according to various embodiments, is a batting pad device for aiding a batter in properly gripping and controlling a bat and for protecting a web area between a thumb and an index finger of a batter's hand, including a proximal joint of the thumb and a proximal joint of the index finger, from injury. The device includes aa body made from a cushioning material and having an opening adapted to fit over the thumb and an appendage to cushion the web area. The appendage has a thickness sufficient to move a first and a second contact point between the bat and the hand such that the first contact point is adjacent to or distal to a proximal interphalangeal joint of the index finger and the second contact point is adjacent to or distal to an interphalangeal joint of the thumb. The appendage has an upper surface and a lower surface, the upper surface contacting the web area of the batter's hand when in use, and the lower surface contacting the bat when the batter grips the bat, wherein the upper surface has a radius of curvature of between about 30 mm and about 35 mm. The appendage has a thickest point located at a distance of less than twenty-five percent of the distance from the opening to the distal end.

The present invention, according to various embodiments, is a batting pad device for aiding a batter in properly gripping and controlling a bat and for protecting a web area between a thumb and an index finger of a batter's hand, including a proximal joint of the thumb and a proximal joint of the index finger, from injury. The device including a body made from a cushioning material and having an opening adapted to fit over the thumb and an appendage to cushion the web area. The appendage has a thickness sufficient to move a contact point between the bat and the hand, the appendage having a thickness of between about 12 mm and about 16 mm and a length of between about 29 mm and about 33 mm.

The present invention, according to various embodiments, is a batting pad device for aiding a batter in properly gripping and controlling a bat and for protecting a web area between a thumb and an index finger of a batter's hand, including a proximal joint of the thumb and a proximal joint of the index finger, from injury. The device includes a body made from a cushioning material and having an opening adapted to fit over the thumb and an appendage to cushion the web area. The appendage has a thickness sufficient to move a first and a second contact point between the bat and the hand such that the first contact point is adjacent to or distal to a proximal interphalangeal joint of the index finger and the second contact point is adjacent to or distal to an interphalangeal joint of the thumb. The appendage has an upper surface and a lower surface, the upper surface contacting the web area of the batter's hand when in use, and the lower surface contacting the bat when the batter grips the bat, wherein the upper surface has a radius of curvature of between about 30 mm and about 35 mm. The appendage has a length (N) and a thickness (T) such that a ration of N/T is between about 1.81 and about 2.83.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

Figure 1:
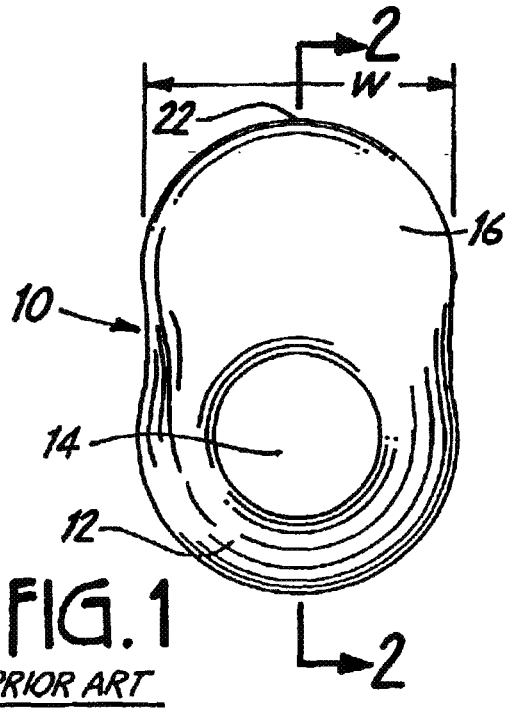
FIG. 1 PRIOR ART
FIG. 1 is a top view of a batting pad such as that disclosed in U.S. Pat. No. 4,461,043.

While the invention is amenable to various modifications and alternative forms, specific embodiments have been shown by way of example in the drawings and are described in detail below. The intention, however, is not to limit the invention to the particular embodiments described. On the contrary, the invention is intended to cover all modifications, equivalents, and alternatives falling within the scope of the invention as defined by the appended claims.

DETAILED DESCRIPTION

Figure 3:
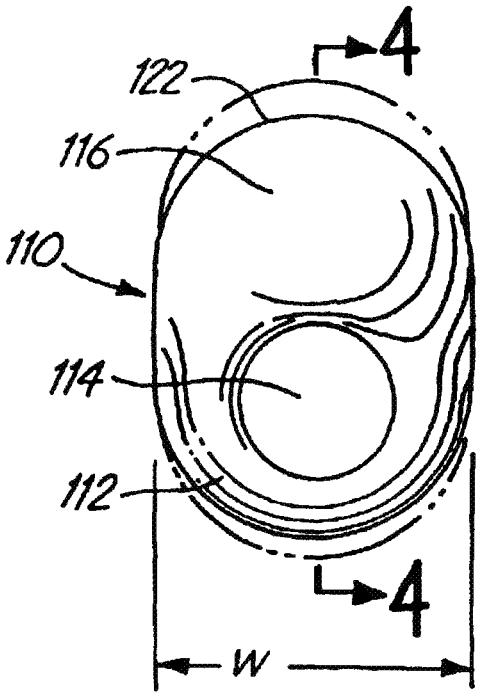
FIG. 3 is a top view of one embodiment of the invention.
Figure 4:
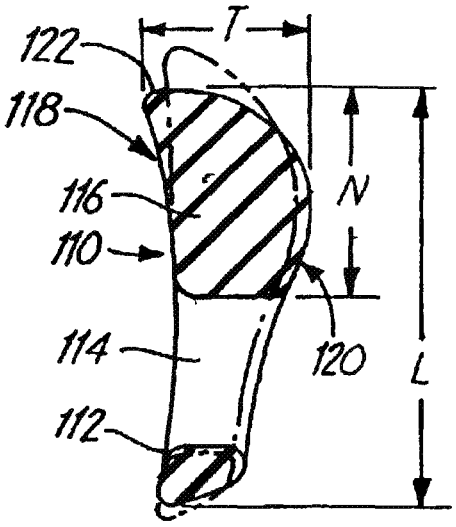
FIG. 4 is a side view of the embodiment of the invention shown in FIG. 1.
Figure 9:
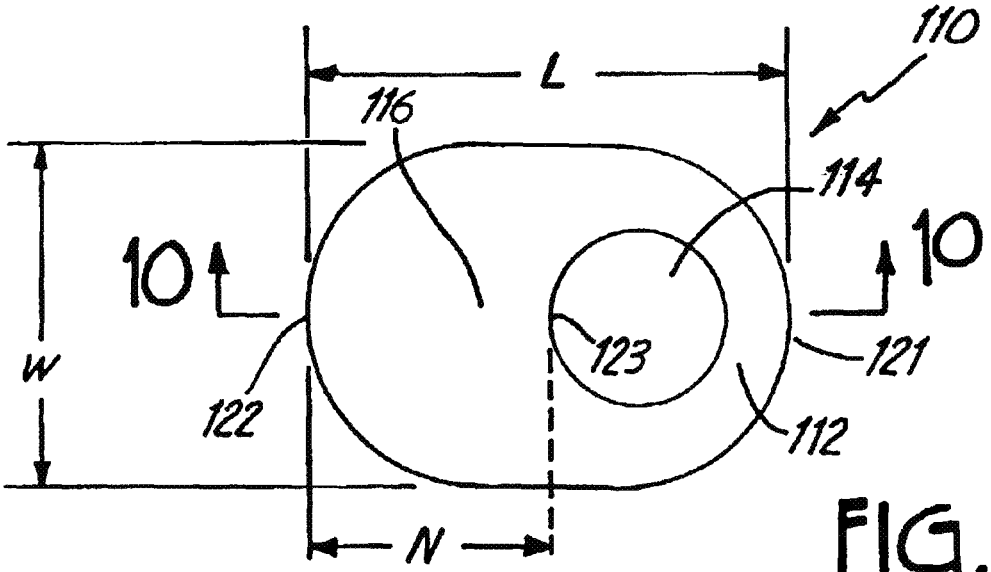
FIG. 9 is a top view of the embodiment of the invention shown in FIG. 3.
Figure 10:
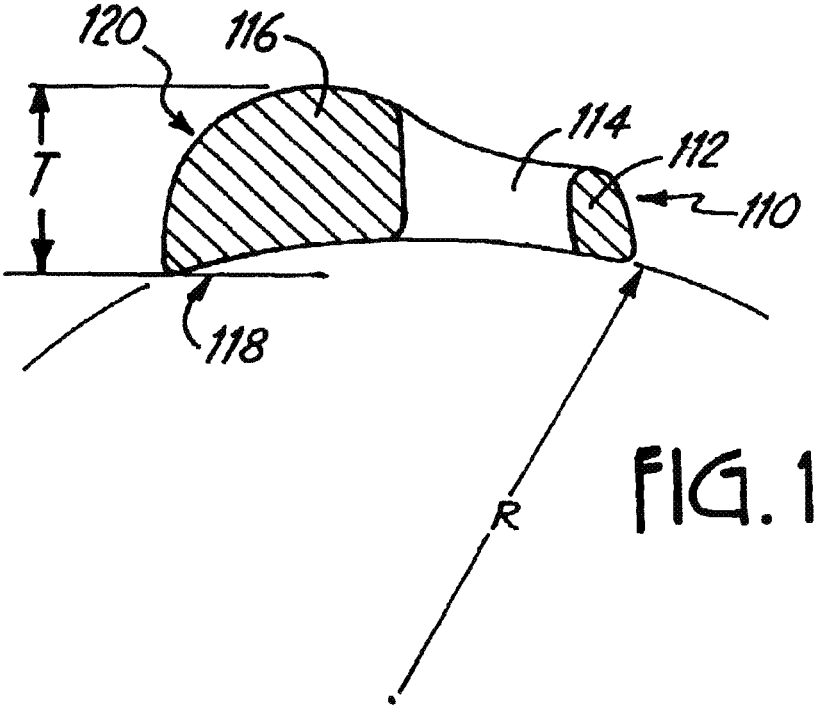
FIG. 10 is a side view of the embodiment of the invention shown in FIG. 3.

Referring to the embodiment of the invention shown in FIGS. 3 and 4, and shown in greater detail in FIGS. 9 and 10, there is shown a batting pad in general comprising a body 110 having a ring portion 112 and an appendage 116. The body 110 of the batting pad can be made from any variety of cushioning material known in the art. In other embodiments, any rubber material can be used to form the body 110 of the batting pad. The body 110 can be one molded piece, such as that illustrated in FIGS. 3, 4, 9, and 10, or it may be any number of pieces bonded together to form a cohesive body 110. The body 110 may also contain a hard plastic or metal skeleton running through its center (not illustrated in the figures). This skeleton can be in the shape of a circle to help form and retain the shape of the body 110 during use. In other embodiments, this metal skeleton may not be used.

The ring portion 112 of the body 110 comprises an opening 114 that is adapted to fit over the batter's thumb 30. This opening 114 can be of varying inside diameter. The opening 114 shown in the embodiment of FIG. 9 is approximately 0.875 inches in inside diameter. The body 110 may have a slightly curved lower surface 118, and the curvature of the lower surface 118 may vary. The radius of curvature of the lower surface 118 illustrated in the embodiment of FIG. 10 is approximately 4 inches. The upper surface 120 of the appendage 116 and the ring portion 112 may be curved at a greater degree than the lower surface 118. The curvature of the upper surface 120 may also vary. The upper surface 120 of the body 110 shown in the embodiment of FIG. 12 has a radius of curvature of approximately 0.8 inches.

Figure 6:
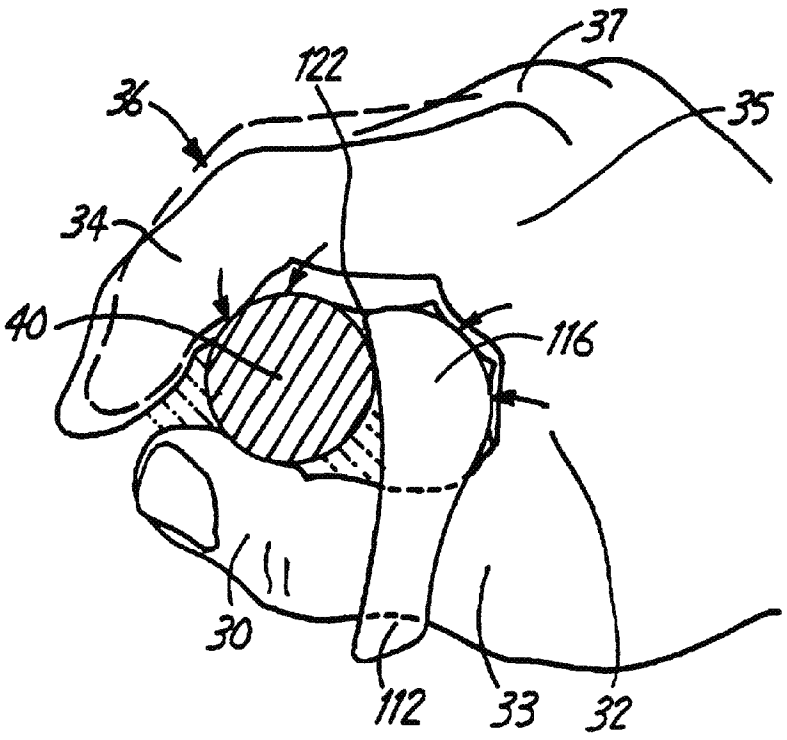
FIG. 6 is a side view of the embodiment of the invention shown in FIG. 3 being loosely held in a batter's hand along with a bat.
Figure 8:
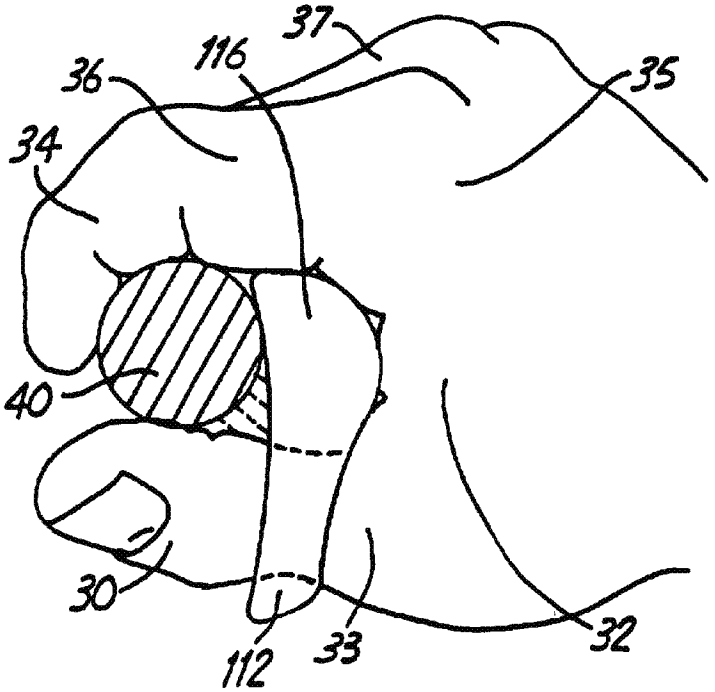
FIG. 8 is a side view of the embodiment of the invention shown in FIG. 3 along with a bat being gripped in a batter's hand.
Figure 16:
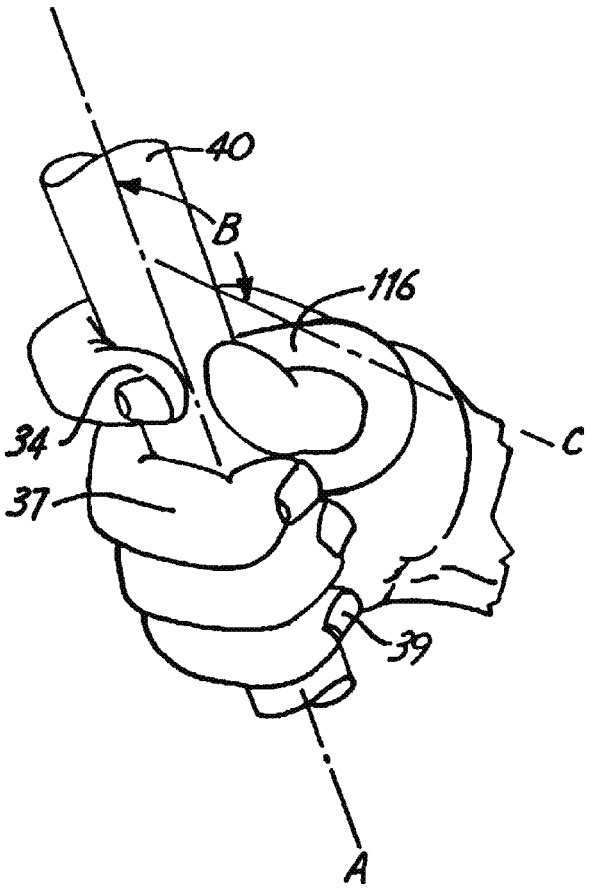
FIG. 16 is a view of the finger position of a batter's hand grasping a bat with the batter using one embodiment of the invention as a batting pad.

Referring to FIGS. 9 and 10, the body 110 has a total length L measured from an outer end 121 of the body 110 adjacent the ring portion 112 to a distant end 122 of the appendage 116. The appendage 116 has a length N measured from a first end 123 of the ring portion 112 to the distant end 122 of the appendage 116. The appendage 116 has a width W and a thickness T at its thickest point. Proper selection of the length N and thickness T are important in the performance of the batting pad. As seen in FIGS. 6, 8, and 16, the ring 114 of the batting pad is placed over the batter's thumb 30 with the appendage 116 extending toward the index finger 34. The thickness T should be selected so that when the batter grips the bat the batting pad is thick enough to force the bat well out on the batter's index finger 34. Because it is important to grip the bat with the fingers, or at least with the index and middle fingers 34, 37 and not with the palm of the hand between the thumb and index finger, the thickness T of the batting pad at its thickest location may be thick enough to displace the bat 40 far enough away from the palm of the hand onto the batter's index finger 34 so that the batter grips the bat 40 with the index finger 34 and middle finger 37 (with the bat 40 resting on the inside tip of the thumb 30) instead of with the palm.

FIG. 16 shows this gripping position with one embodiment of the invention. If the length N of the appendage 116 is too great, the appendage 116 will be compressed in a longitudinal direction when the bat 40 is gripped, as seen in the view of a batting pad (such as that of U.S. Pat. No. 4,461,043) in FIG. 7. The batting pad does not readily fit in the batter's hand when the bat 40 is being gripped, because the batter is forced to apply force to compress the batting pad in a longitudinal direction in order to grasp the bat 40, as in FIG. 7. The length N of the appendage 116 of the invention, therefore, should be selected such that the appendage 116 is not compressed in length when the bat 40 is in use. The reduction of the relative length N of the appendage, and therefore the total length L of the body, allows batters with smaller hands to fit their index fingers 34 around the batting pad and bat 40; hence, a reduced length N allows these users to benefit from the invention.

As can be seen in FIGS. 6 and 8, the curved upper surface 120 of the invention contacts the palm area of the hand between the index finger 34 and the thumb 30 more readily and more smoothly than does the batting pad of U.S. Pat. No. 4,461,043; that is, the upper surface 120 lies in essentially continuous contact with the palm area. This area of the palm, referenced as 32 in the figures, is defined by the area between two joints on the batter's hand. The first joint is the metacarpal phalangeal joint 33 of the thumb 30, hereinafter referred to as the proximal joint of the thumb 30, which is the joint between the metacarpal bone and the proximal phalanx bone of the thumb 30. The second joint is the metacarpal phalangeal joint 35 of the index finger 34, hereinafter referred to as the proximal joint of the index finger 34, which is the joint between the metacarpal bone and the proximal phalanx bone of the index finger 34. The thickest point T of the appendage 116 should contact the palm area of the hand between the proximal joint 33 of the thumb 30 and the proximal joint 35 of the index finger 34.

Similarly, if the curvature of the upper surface 120 of the appendage 116 is properly selected, the upper surface 120 should readily and smoothly contact the palm area 32 of the batter's hand between the proximal joint 33 of the thumb 30 and the proximal joint 35 of the index finger 34. If the length N and thickness T of the appendage 116 are properly selected, the distant end 122 of the appendage 116 should contact the palm area near the proximal joint 35 of the batter's index finger 34 so that the appendage 116 is not compressed along its length when the bat 40 is gripped.

A comparison of the present invention to the batting pad disclosed in U.S. Pat. No. 4,461,043 illustrates a number of differences between the batting pads. FIGS. 3 and 4 show the present invention in solid lines with a batting pad such as that of U.S. Pat. No. 4,461,043 in phantom lines. As can be seen in FIGS. 3 and 4, the batting pad of U.S. Pat. No. 4,461,043 is both longer and thinner. The increased thickness T and decreased length N of the present invention ensure a better fit of the batting pad in the batter's hand. The increased thickness T also increases the protective padding in the area near the joint between the thumb 30 and hand where some batters frequently bruise.

Figure 5:
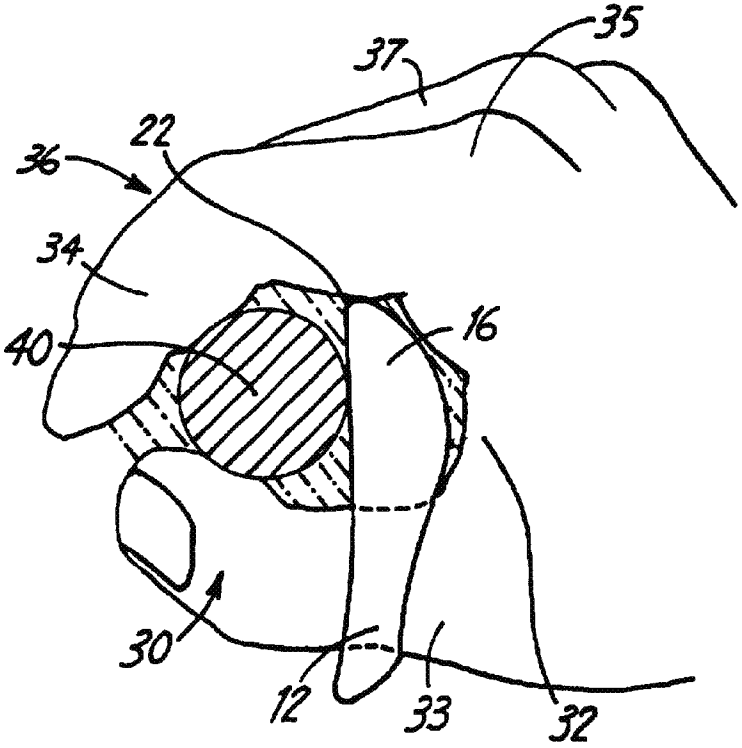
FIG. 5 is a side view of the batting pad shown in FIG. 1 along with a bat being loosely held in a batter's hand.
Figure 7:
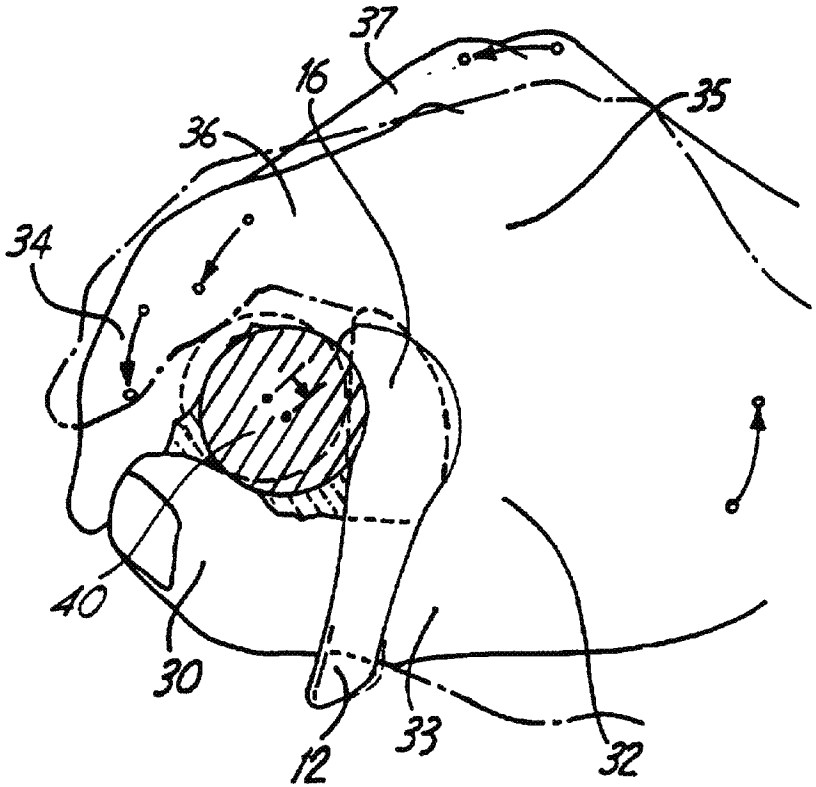
FIG. 7 is a side view of the batting pad shown in FIG. 1 along with a bat being gripped in a batter's hand.

FIGS. 5 through 8 illustrate some of the important differences between the present invention and the batting pad of U.S. Pat. No. 4,461,043. FIGS. 5 and 7 illustrate the batting pad of U.S. Pat. No. 4,461,043 in the loosely held and gripped positions respectively. FIGS. 6 and 8, similarly, illustrate the batting pad of one embodiment of the invention in the loosely held and gripped positions. A comparison between the spacing of the batting pads in FIGS. 5 and 6 in the batter's hand shows that the invention fits more snugly in the batter's hand when the bat is loosely held than does the batting pad of U.S. Pat. No. 4,461,043 when it is loosely held. Because the appendage 116 of the invention may be shorter in length N and have a greater thickness T than the batting pad of U.S. Pat. No. 4,461,043, the invention is shaped to conform to the batter's hand better than the batting pad of U.S. Pat. No. 4,461,043. The shorter length N of the appendage 116 of the invention also allows the batter's index finger 34 to contact the bat 40 with a greater proportion of the surface of this finger than does the batting pad of U.S. Pat. No. 4,461,043.

FIGS. 7 and 8 demonstrate some of the advantages of the invention over the batting pad of U.S. Pat. No. 4,461,043 when the bat 40 is in the gripped position. The shorter length N and larger thickness T of the invention allow the batter to more easily grasp the bat 40 than does the batting pad of U.S. Pat. No. 4,461,043. FIG. 7 illustrates the motion of the batter's hand and index finger 34 in grasping the bat 40 with the batting pad of U.S. Pat. No. 4,461,043 in place. Because the invention pushes the bat 40 further onto the batter's index finger 34 and away from the batter's palm, as shown in FIG. 8, the batter need only close the fingers slightly to grasp the bat 40 as desired. Little or none of the batter's finger strength need be used to longitudinally compress the appendage 116. The greater distance of the bat 40 from the batter's palm also causes the batter to grip the bat 40 with the batter's index finger 34 and middle finger 37 (with the bat 40 supported in place by the inside tip of the thumb 30). This gripping position using one embodiment of the invention provides the batter with greater bat control, leverage, speed, and power than if no batting pad or the batting pad of U.S. Pat. No. 4,461,043 is used.

Figure 11:
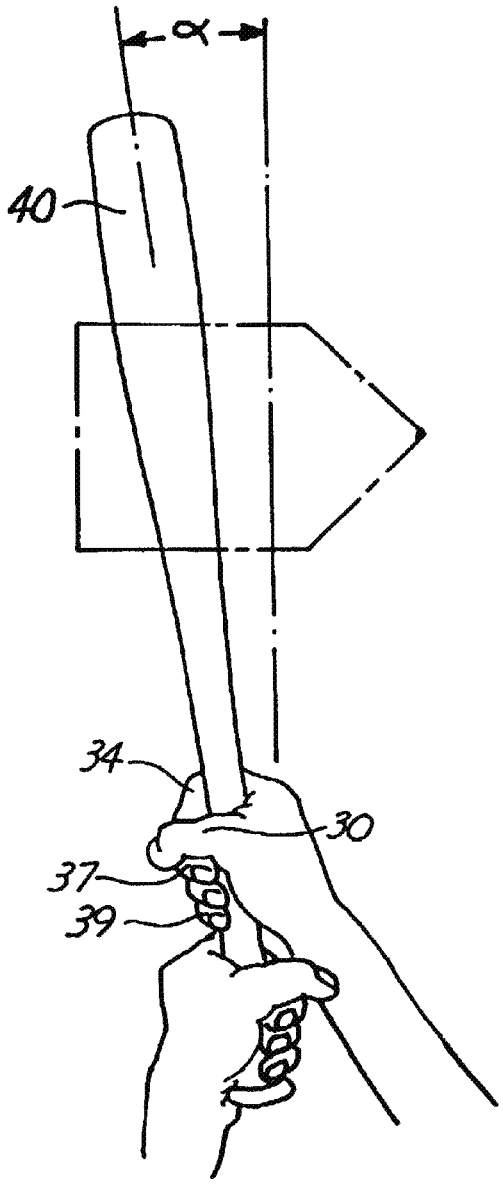
FIG. 11 is a top view above a plate of a bat in a batter's hands without the use of a batting pad.
Figure 12:
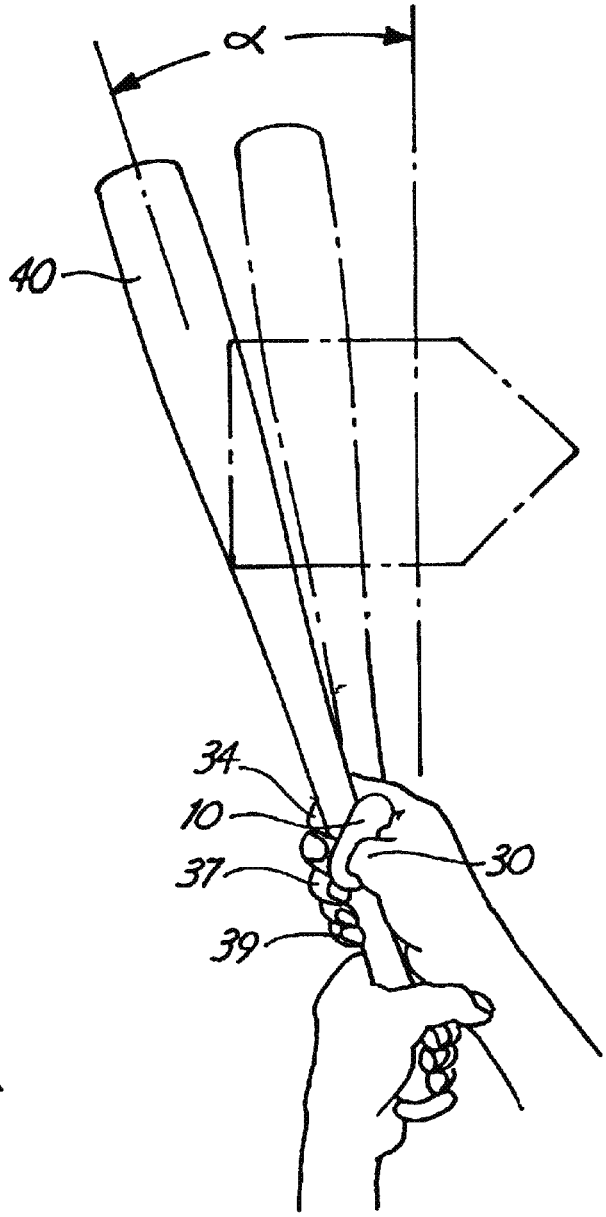
FIG. 12 is a top view above a plate of a bat in a batter's hands with the batter using a batting pad such as that disclosed in U.S. Pat. No. 4,461,043.
Figure 13:
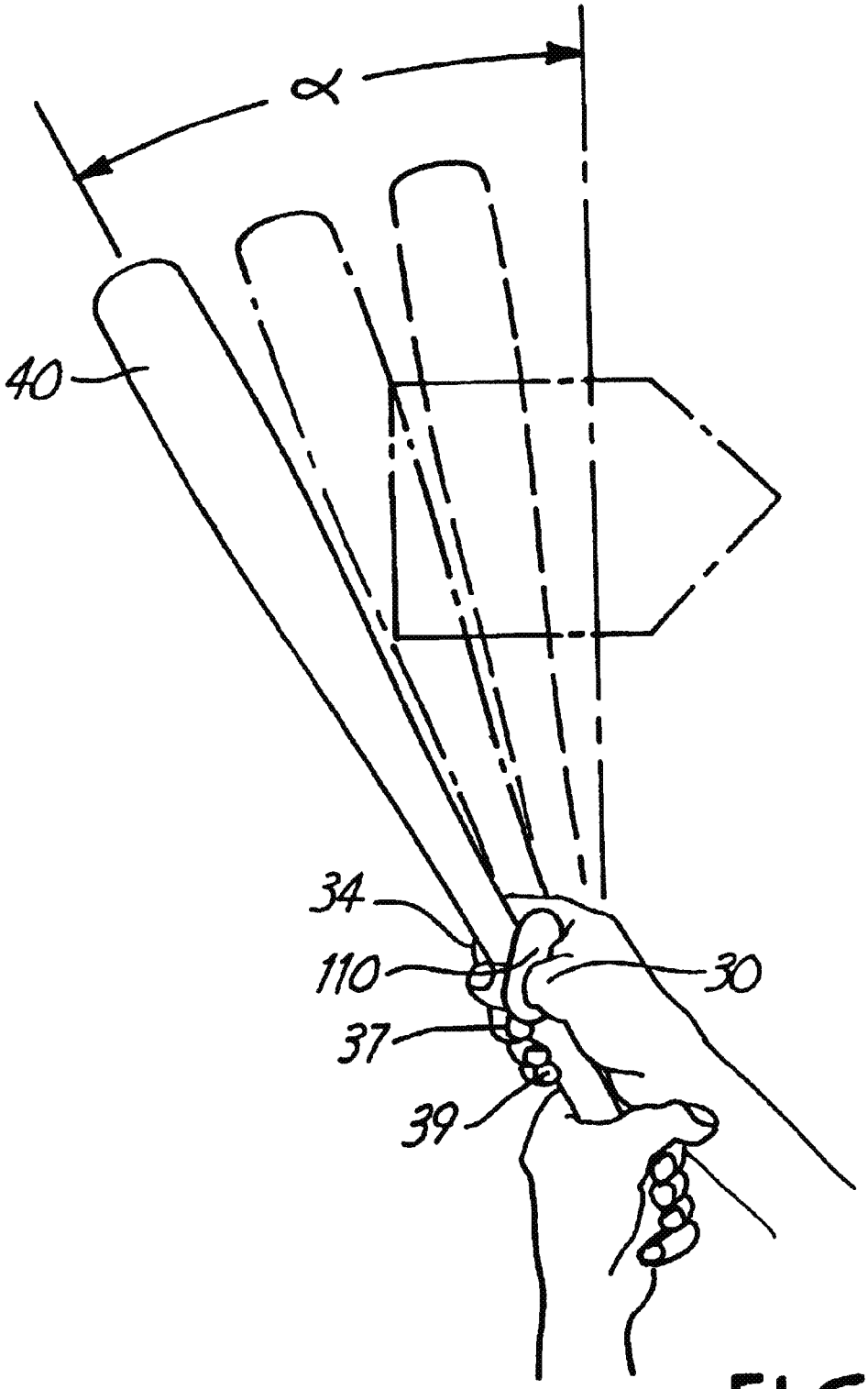
FIG. 13 is a top view above a plate of a bat in a batter's hands with the batter using one embodiment of the invention as a batting pad.

The increased thickness T of the invention also increases the angle a of the bat 40 in the batter's hand, as shown in FIGS. 11-16. FIGS. 11-13 show, from a view above home plate looking down, a bat passing through the strike zone (moving counter-clockwise as viewed in FIGS. 11-13). FIG. 11 shows the use of no batting pad to grip the bat 40, FIG. 12 shows the use of a batting pad such as that of U.S. Pat. No. 4,461,043 to grip a bat 40, and FIG. 13 illustrates an embodiment of the present invention in use with a bat 40. FIG. 12 shows in phantom lines the bat position of FIG. 11, and FIG. 13 shows in phantom lines the bat positions of FIGS. 11 and 12. In FIGS. 11-13, the angle a is the angle between the bat 40 and a horizontal line oriented generally perpendicular to a line between home plate and the pitcher's mound. FIGS. 11-13 show the position of the bat 40 at the same point in the batter's swing, such that the batter's wrists are in the same position in each figure. The increase of the angle a in FIG. 12 as compared to FIG. 11 is caused by the use of a batting pad such as that of U.S. Pat. No. 4,461,043, and the further increase of the angle a in FIG. 13 over the angle a in FIG. 12 is caused by the increased thickness T of the invention in comparison to the batting pad of U.S. Pat. No. 4,461,043. FIG. 13 also shows in phantom lines the bat position of FIG. 12 (and FIG. 11 as well), which further illustrates the difference in bat position.

Figure 14:
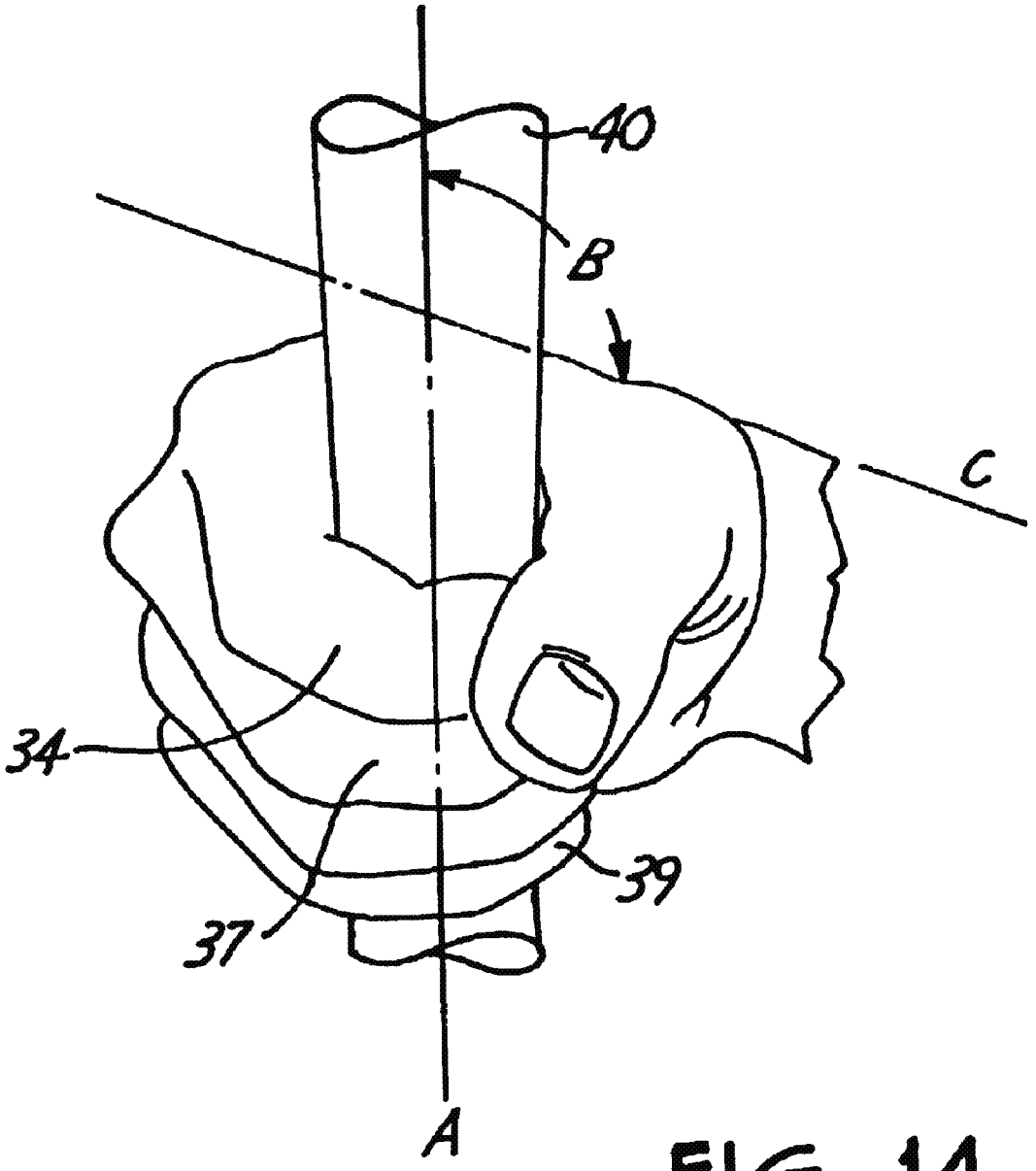
FIG. 14 is a view of the finger position of a batter's hand grasping a bat without the use of a batting pad.
Figure 15:
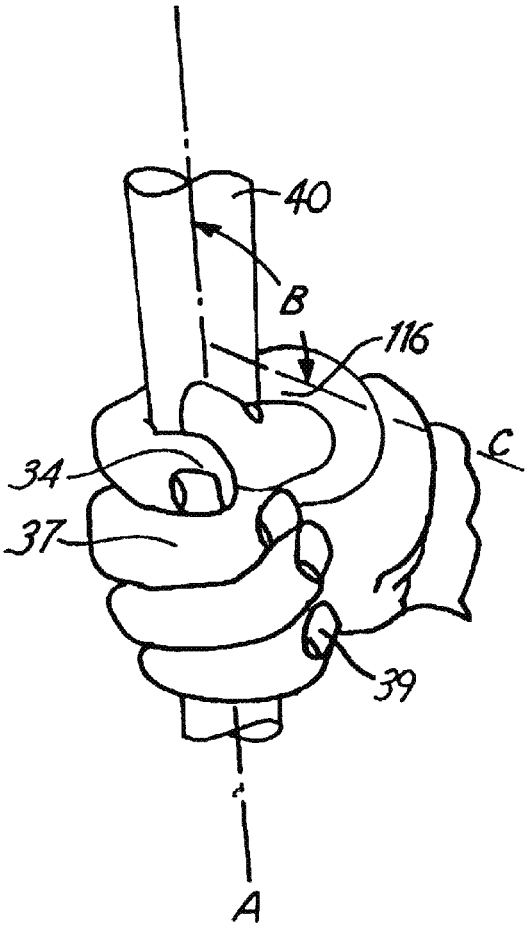
FIG. 15 is a view of the finger position of a batter's hand grasping a bat with the batter using a batting pad such as that shown in U.S. Pat. No. 4,461,043.

FIG. 16 illustrates a view of the bat 40 in the batter's hand with an embodiment of the invention in use, and FIGS. 14-15 show the same view with no batting aid and the batting aid of U.S. Pat. No. 4,461,043 respectively. The angle 11 in FIG. 16 is the angle between a line parallel to the bat (denoted by A in FIGS. 14-16) and a line formed generally parallel to the batter's forearm (denoted by C in FIGS. 14-16). The increased thickness T of the invention (FIG. 16) displaces the bat 40 outward toward the tip of the batter's index finger 34 (and against the inside top of the thumb 30) with the batting pad of the invention, while at the same time causing the end of the bat 40 near the batter's little finger 39 to move toward the palm of the batter's hand. Thus, the bottom portion of the bat 40 near the knob of the bat 40 is more toward the palm of the batter's hand. The thickness T of the appendage, therefore, can be selected relative to the batter's hand size to optimize this angle β of the bat 40 in the batter's hand. The batter should still be able to grip the bat 40 with the index and middle fingers 34, 37, but the bat 40 should be in or near the palm of the hand near the batter's little finger 39. An increased angle 13 rotates the end of the bat 40 opposite the batter's hand further toward reference line C in FIG. 16.

When the batter swings the bat 40 (as shown in FIG. 13), the area of the bat 40 ideal for hitting the ball as the ball approaches the front of the plate passes through the hitting zone at an earlier point in the batter's swing than if no batting pad or if the batting pad of U.S. Pat. No. 4,461,043 is used (as shown in FIGS. 14-15). At the point in the batter's swing when the batter breaks or turns over his or her wrists, therefore, the bat 40 has moved further through the hitting zone than if no batting pad or if the batting pad of U.S. Pat. No. 4,461,043 is used. The optimization of this angle R of the bat 40 in the batter's hand allows the batter to swing the bat 40 at the proper angle through the hitting zone, thus helping the batter's batting proficiency and increasing the batter's leverage and bat speed. FIG. 15 illustrates the use of the batting pad of U.S. Pat. No. 4,461,043. Because the batting pad shown in FIG. 15 does not push the batting pad toward the tip of the index finger 34 (as does the batting pad of FIG. 16), the angle R in FIG. 15 is smaller than the angle R in FIG. 16, and the angle R is not optimized for batting.

FIG. 16 also illustrates the position of the bat 40 in the batter's hand relative to the batter's index finger 34 and middle finger 37 with a batting pad of the invention. FIG. 15 illustrates the same position for the batting pad of U.S. Pat. No. 4,461,043. The batting pad in FIG. 16 moves the bat nearer the tip of the index finger 34 than does the batting pad of FIG. 15, as can be seen in a comparison of these two figures. In addition, the batting pad of FIG. 16 may create a gap of approximately ¼ to 2 inch between the index finger 34 and middle finger 37. This gap, which is created by the batting pad of the invention, may create a "V" position between the index finger 34 and middle finger 37, as can be seen in FIG. 16. The bat position and grip position shown in FIG. 16 may translate into improved bat control, leverage, speed, and power for the batter.

Although the total length L, width W, and thickness T of the body 110 and length N of the appendage 116 may vary to accommodate differing hand sizes of batters, certain ratios between these dimensions may remain within set ranges in one embodiment of the invention.

For instance, the total length L of the body 110, in this embodiment, should preferably be greater than the width W of the body 110. In this embodiment, a second important ratio that preferably should remain within a given range is the ratio WI' of the length N to the thickness T of the body 110. The embodiment of the invention shown in FIGS. 3-4 and 9-10 has a length N of approximately 1.2 inches and a thickness T of approximately 1 inch. The ratio N/T of the length N to the thickness T of the embodiment shown in FIGS. 3-4 and 9-10 is approximately 1.2, but this ratio can vary somewhat as well. In the embodiment of the invention shown in FIGS. 3-4 and 9-10, the ratio N/T preferably is 1.6 or less, and in another embodiment, 1.3 or less. In yet another embodiment, the ratio N/T is 1.2 or less.

Figure 2:
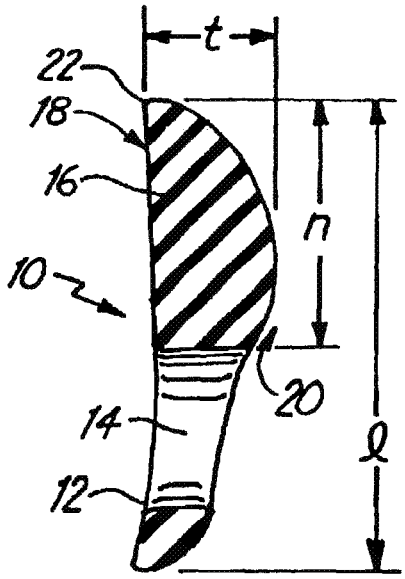
FIG. 2 PRIOR ART
FIG. 2 is side view of the batting pad shown in FIG. 1.

The total length I of a batting pad such as that of U.S. Pat. No. 4,461,043 is approximately 2.5 inches and the thickness t at its thickest point is approximately 0.75 inches (see FIGS. 1-2). The length n of the flap portion 16 is approximately 1.25 inches. The ratio n/t of the length n to the thickness t of this batting pad is therefore approximately 1.66. Because the length n of this batting pad is greater than the length N of the present invention, and because the thickness t of this batting pad is smaller than the thickness T of the invention (at least in relative terms to the other dimensions of the batting pad), the radius of curvature of the upper surface 20 of the batting pad of U.S. Pat. No. 4,461,043 is greater than that of the present invention.

Figure 17:
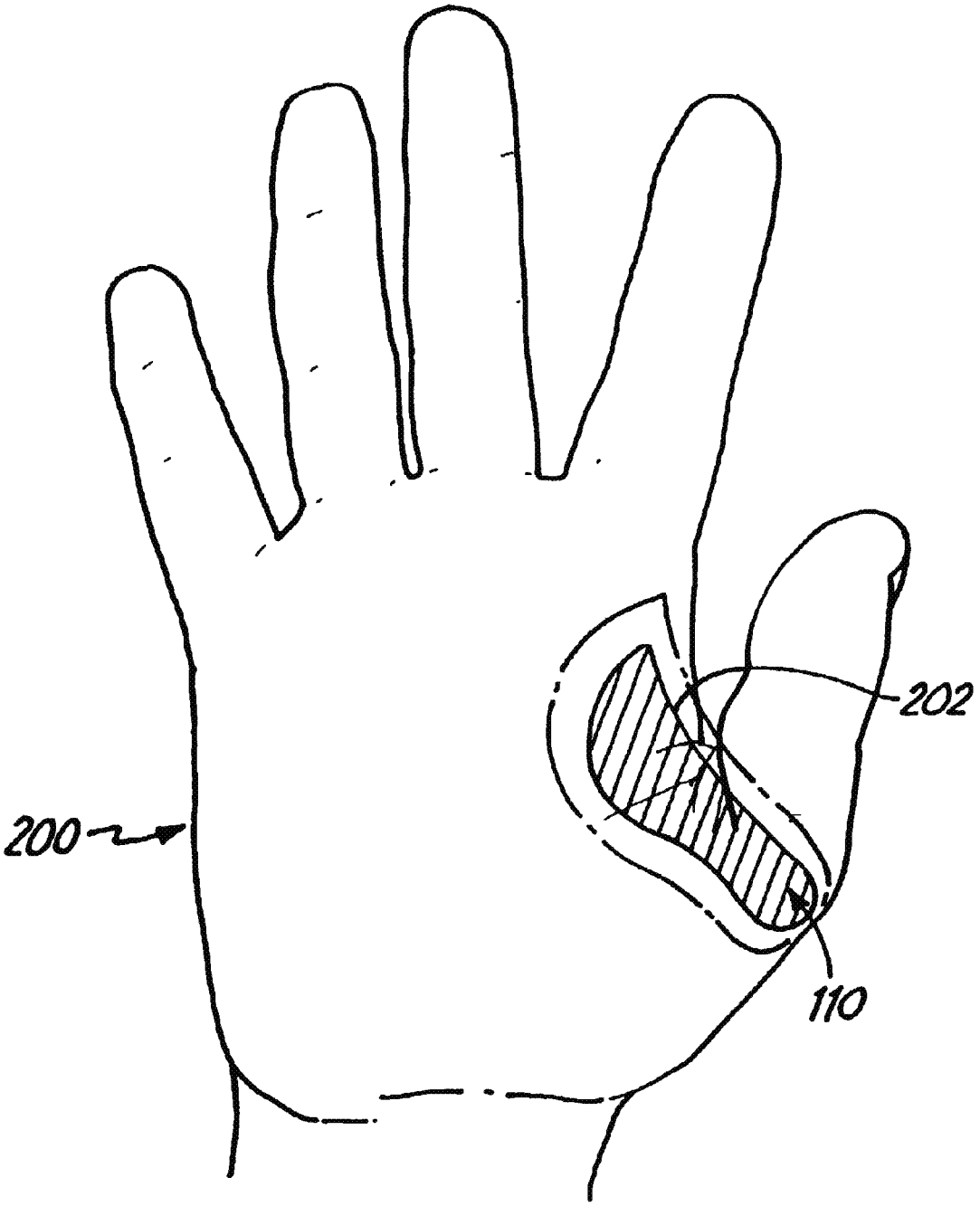
FIG. 17 is a view of a glove containing one embodiment of the batting pad of the invention.

Although the body 110 of the invention can be used in isolation as in FIGS. 6, 8, 13, and 16, it may also be used in conjunction with a batters glove, as shown in FIG. 17. In this embodiment, the body 110 could be incorporated into a batting glove 200, such that a batter can put on the body 110 and batting glove 200 in one quick action. In this embodiment, a pocket 202 may be formed in the area of the batting glove 200 between the index finger 34 and the thumb 30 for placement of the body 110 of the invention. In other embodiments, the batting pad of the invention could be built on the outside of the glove 200 or in the inside of the glove 200.

Figure 18A:
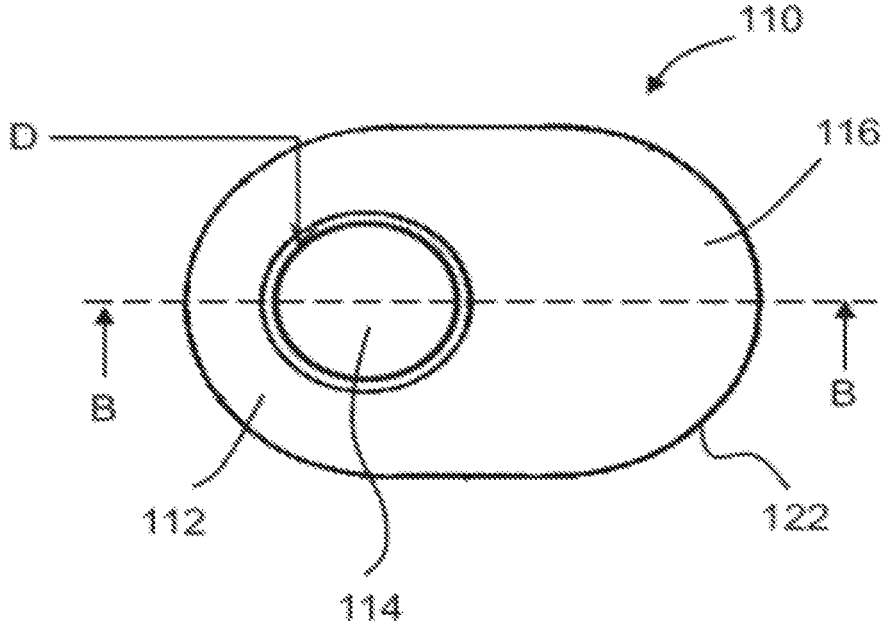
FIG. 18A is a plan view of a batting pad according to embodiments of the invention.
Figure 18B:
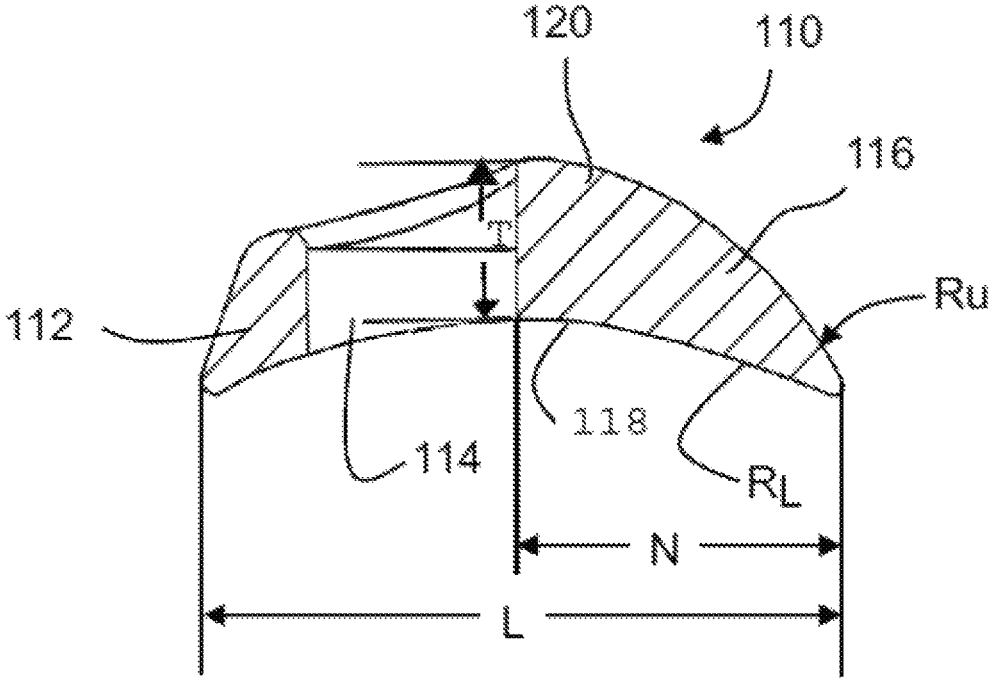
FIG. 18B is a sectional view of the batting pad of FIG. 18A, along the line B-B, according to embodiments of the invention.

FIGS. 18A and 18B show a batting pad according to another embodiment of the invention. As shown, in these embodiments, the body 110 of the batting pad has a total length (L) of about 63 millimeters (mm) and a width (W) of about 39 mm. In various exemplary embodiments, the length (L) is between about 58 mm and about 65 mm and the width (W) is between about 37 mm and about 40 mm. As best shown in FIG. 18B, the appendage 116 (i.e., the portion of the pad extending from the user's thumb) has a length (N) of about 31 mm and a thickness (T) of about 14 mm. As shown in FIG. 18B, the batting pad has a ration of length to thickness (N/T) of about 2.21. According to various embodiments, the length (N) is between about 29 mm and about 34 mm and the thickness (T) is between about 12 mm and about 16 mm. In these embodiments, the ratio of N/T is between about 1.81 and about 2.83.

As also shown in FIG. 18B, the upper surface 120 (i.e., the portion of the batting pad in contact with user's palm during use) has a radius of curvature (Ru) of 33 mm, and the lower surface 118 of the batting pad has a radius of curvature (RI) of about 67 mm. According to various embodiments the upper surface 120 has a radius of curvature of between about 30 mm and about 35 mm, while the lower surface 118 has a radius of curvature of between about 60 mm and about 70 mm. In addition, as shown in FIGS. 18A and 18B, the thickest point of the appendage 116 is located at or near the opening 114. In various embodiments, the thickest point of the appendage 116 is located at the opening 114. In other embodiments, the thickest point of the appendage 116 is located within no more than twenty-five percent of the distance from the opening 114 to the distal (i.e., far) end of the appendage 116. In other embodiments, the thickest point is located no more that fifteen percent of the distance from the opening 114 to the distal end of the appendage 116. According to various embodiments, the batting pad includes an upper surface having a radius of curvature of between about 30 mm and about 35 mm, and further includes an appendage 116 having a thickest point located at or near the opening 114. According to various embodiments, as shown in FIGS. 18A and 18B, the opening 114 has a diameter of between about 18 mm and about 20 mm. As further shown, the pad, in the area surrounding the opening 114 has a radius of curvature of about 19 mm, which provide the pad with an effective fit to the batter's hand.

The invention described above aids the batter in properly gripping a bat. The selection of a proper thickness T and length N of the appendage causes the batter to grip the bat with the index and middle fingers 34, 37 (and held in place by the inside portion of the thumb 30) and increases the angle of the bat in the batter's hand. The invention, therefore, improves a batter's technique in properly gripping a bat. The correct gripping technique may translate into improved bat control, leverage, speed, and power, thus aiding a batter in more consistently and powerfully hitting a ball.

While the present invention has been described with reference to several embodiments thereof, those skilled in the art will recognize various changes that may be made without departing from the spirit and scope of the claimed invention. Accordingly, this invention is not limited to what is shown in the drawings and described in the specification but only as indicated in the appended claims.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

I claim:

1. A batting pad device for aiding a batter in gripping and controlling a bat and for protecting a web area between a thumb and an index finger of a batter's hand, the device comprising:

a body having an opening to be fitted over the thumb and an appendage to extend at least partially adjacent the web area;

wherein the appendage is configured to have a first contact point and a second contact point between the bat and the hand such that the first contact point is adjacent to or distal to a proximal interphalangeal joint of the index finger and the second contact point is adjacent to or distal to an interphalangeal joint of the thumb; and wherein the appendage has an upper surface to contact the web area of the batter's hand, and a lower surface to contact the bat when the batter grips the bat, and the appendage has a thickest point located at a distance of less than twenty-five percent of the distance from the opening to a distal end of the appendage.

2. The device of claim 1, wherein the upper surface has a radius of curvature of between 30 mm and 35 mm.

3. The device of claim 1, wherein the appendage has a thickness of between 12 mm and 16 mm and a length of between 29 mm and 33 mm.

4. The device of claim 1, wherein the lower surface has a concave curvature having a radius of curvature of between 60 mm and 70 mm.

5. A batting pad device for aiding a batter in properly gripping and controlling a bat and for protecting a web area between a thumb and an index finger of a batter's hand, the device comprising:

a body having an opening to be fit over the thumb and an appendage to extend at least partially adjacent the web area;

wherein the appendage is configured to have a contact point between the bat and the hand such that the contact point is adjacent to or distal to a joint of the index finger; and wherein the appendage has a thickest point located twenty-five percent of the distance from the opening to a distal end of the appendage.

6. The device of claim 5, wherein the appendage has a thickness of between 12 mm and 16 mm and a length of between 29 mm and 33 mm.

7. The device of claim 5, wherein the appendage has a lower surface to contact the bat when the batter grips the bat, the lower surface having a concave curvature having a radius of curvature of between 60 mm and 70 mm.

8. The device of claim 5, wherein the appendage has an upper surface to contact the web area, the upper surface having a radius of curvature of between 30 mm and 35 mm.

9. The device of claim 8, wherein the appendage has a length such that, when the batter grips the bat, the appendage is free of longitudinal compression.

10. A batting pad device for aiding a batter in gripping and controlling a bat and for protecting a web area between a thumb and an index finger of a batter's hand, the device comprising:

a body having an opening to be fitted over the thumb and an appendage to cushion the web area;

wherein the appendage is configured to have a first contact point and a second contact point between the bat and the hand such that the first contact point is adjacent to or distal to a joint of the index finger and the second contact point is adjacent to or distal to a joint of the thumb; and wherein the appendage has a thickest point located at a distance of less than twenty-five percent of the distance from the opening to a distal end of the appendage.

11. The device of claim 10, wherein the appendage has an upper surface to contact the web area of the batter's hand when in use, and the upper surface has a radius of curvature of between 30 mm and 35 mm.

12. The device of claim 10, wherein the appendage has a lower surface to contact the bat when the batter grips the bat, the lower surface having a concave curvature having a radius of curvature of between 60 mm and 70 mm.

13. The device of claim 10, wherein the appendage has a length (N) and a thickness (T) such that a ratio of N/T is between 1.81 and 2.83.

* * * * *